US005350320A

United States Patent [19]

Hashizawa et al.

[11] Patent Number: 5,350,320

[45] Date of Patent: Sep. 27, 1994

[54] ELECTRICAL CONNECTOR

[75] Inventors: Shigemi Hashizawa; Shinichi Tsuchiya, both of Shizuoka, Japan

[73] Assignee: Yazaki Corporation, Tokyo, Japan

[21] Appl. No.: 110,994

[22] Filed: Aug. 24, 1993

[30] Foreign Application Priority Data

Aug. 25, 1992 [JP] Japan ..... 4-225808

[51] Int. Cl.[5] ..... H01R 13/436

[52] U.S. Cl. ..... 439/752

[58] Field of Search ..... 439/752, 595, 570, 573

[56] References Cited

FOREIGN PATENT DOCUMENTS 62-153773 9/1987 Japan .

*Primary Examiner*—Gary F. Paumen

*Attorney, Agent, or Firm*—Finnegan, Henderson, Farabow, Garrett & Dunner

[57] ABSTRACT

An electrical connector in which bolts can not be fastened due to the objection of a rear holder unless terminals are fully inserted into terminal accommodating cavities in a connector housing. The electrical connector according to the present invention comprises: a connector housing having terminal accommodating cavities and brackets with mounting holes; and a rear holder inserted into the connector housing, the rear holder having arms for preventing terminals, which are accommodated in the terminal accommodating cavities, from being slipped off such that an end of the arm abuts a rear portion of the terminal, the rear holder further having bolt holes which overlap the mounting holes of the brackets of the housing in a fully locked state of the rear holder to the connector housing.

3 Claims, 4 Drawing Sheets

ELECTRICAL CONNECTOR

BACKGROUND OF THE INVENTION

1. Field of the Invention

The present invention relates to an electrical connector, and more particularly to, an electrical connector in which bolts can not be fastened due to the objection of a rear holder unless terminals are fully inserted into terminal accommodating cavities in a connector housing.

2. Description of the Prior Art

FIG. 8 shows a conventional connector with a function of preventing terminals from being slipped off, which is disclosed in Japanese Utility Model Application No. Showa 62-153773.

The connector 40 is provided with a connector housing 41 made of synthetic resin. A terminal locking lance 44 is formed on a bottom wall 43 of terminal accommodating cavities 42 of the housing 41. Further, a rear holder 48 is integrally formed with the housing 41 at a portion adjacent to a rear opening 47 of the terminal accommodating cavities 42 via a hinge 46. The rear holder 48 is to be inserted into the rear opening 47 and a front end thereof 48*a* abuts a rear end of the terminal 49 in the terminal accommodating cavity 42 to doubly lock the terminal 49 together with the locking lance 44.

However, with the conventional construction described above, there is a possibility that the connector 40 is delivered to the market without the insertion of the rear holder 48, particularly, a problem of slipping off of the terminal 49 arises when the insertion of the terminal 49 is incomplete.

SUMMARY OF THE INVENTION

The present invention has been accomplished to eliminate the drawbacks of the conventional connector and the object thereof is to provide an electrical connector in which the incomplete insertion of the terminals is certainly detected to prevent the delivery of such defective connectors. An electrical interconnection assembly manufacturing apparatus according to the present invention comprises: a connector housing having terminal accommodating cavities and brackets with mounting holes; and a rear holder inserted into the connector housing, the rear holder having arms for preventing terminals, which are accommodated in the terminal accommodating cavities, from being slipped off such that an end of the arm abuts a rear portion of the terminal, the rear holder further having bolt holes which overlap the mounting holes of the brackets of the housing in a fully locked state of the rear holder to the connector housing.

Another electrical connector according to the present invention further comprises: a locking portion of the connector housing; a pair of resilient vertical side walls attached to the rear holder; a preliminary locking projection with a forwardly inclined face and a preliminary locking maintaining projection with forwardly abutting face attached to the side walls for the locking portion of the connector housing, wherein the locking portion of the connector housing is positioned between the preliminary locking projection and the preliminary locking maintaining projection.

Further object of the present invention is to provide an electrical connector in which the rear holder is further inserted into the connector housing while the pair of resilient side walls being inwardly bent to disconnect the preliminary locking maintaining projection from the locking portion of the connector housing and to move the rear holder and the connector housing to the fully locked state.

BRIEF DESCRIPTION OF THE DRAWINGS

The present invention will be more apparent from the ensuring description with reference to the accompanying drawing wherein.

DETAILED DESCRIPTION OF PREFERRED EMBODIMENTS

Figure 1:
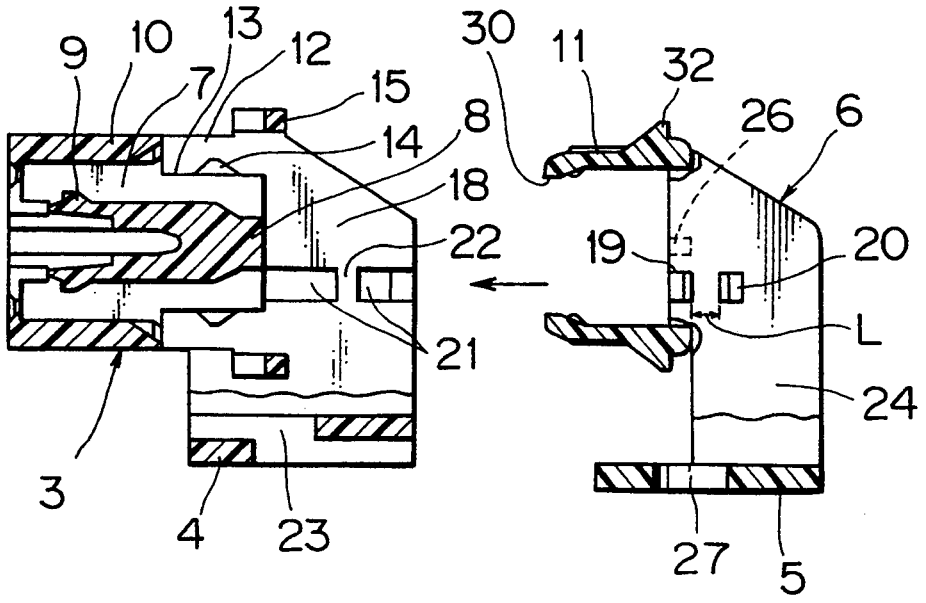
FIG. 1 is a longitudinally cross-sectional view of a connector according to an embodiment of the present invention.

A connector 1 comprises a connector housing 3 made of synthetic resin, brackets 4 and 4' integrally formed with the housing 3, and a rear holder 6 made of synthetic resin for preventing terminals 2 form being slipped off. The rear holder 6 is inserted into the connector housing 3 and is provided with brackets 5 and 5' which are used to fix the rear holder 6 to the housing 3 together with brackets 4 and 4'.

Figure 4:
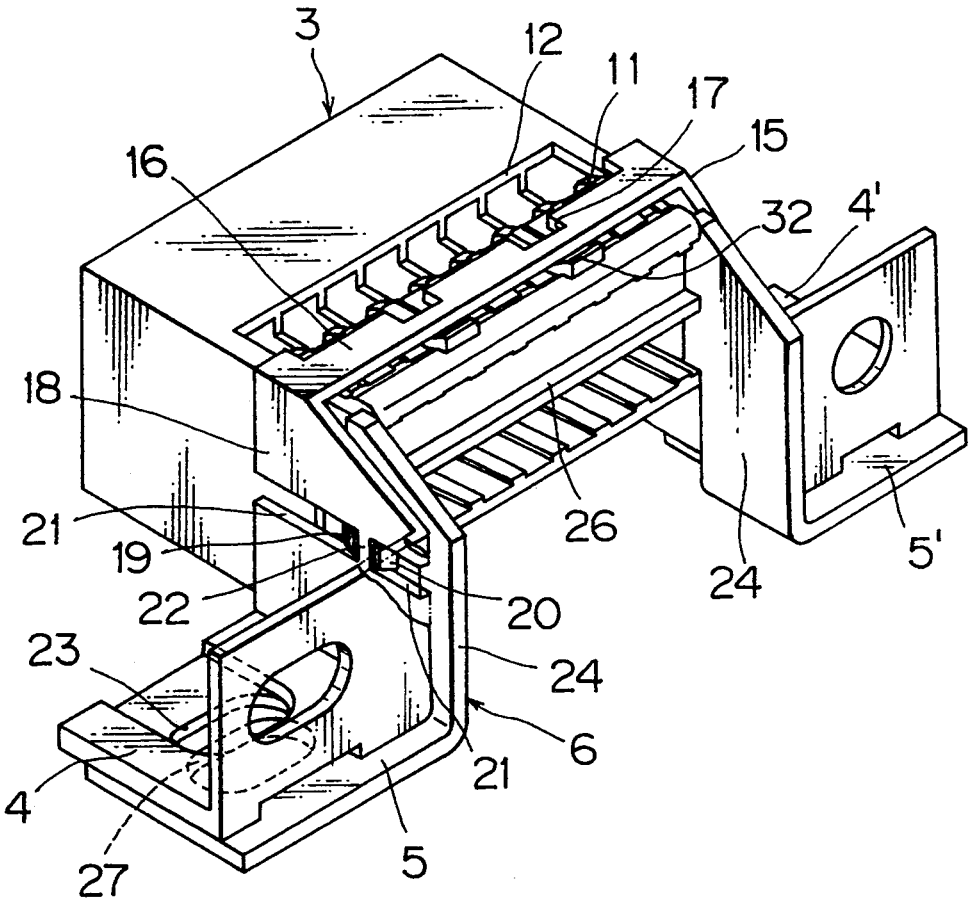
FIG. 4 is a perspective view of the connector shown in FIG. 1 under the preliminarily locked state of the rear holder to the housing.
Figure 5:
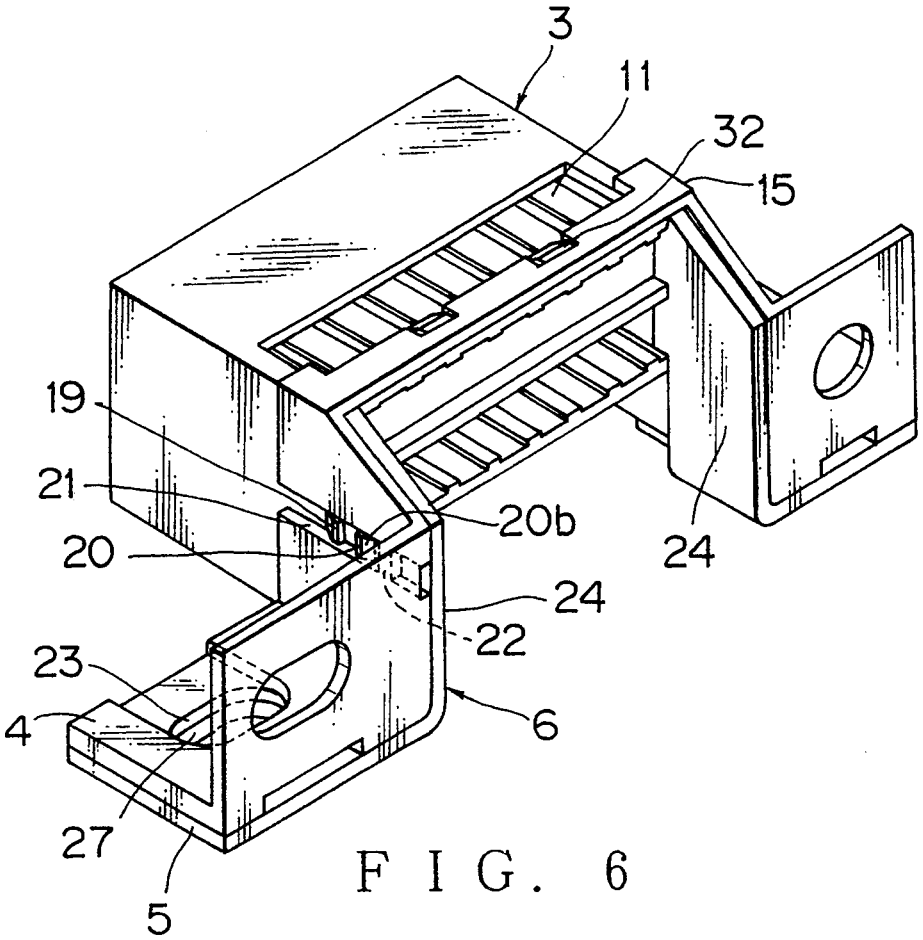
FIG. 5 is a perspective view of the connector shown in FIG. 1 under the fully locked state of the rear holder to the housing.
Figure 6:
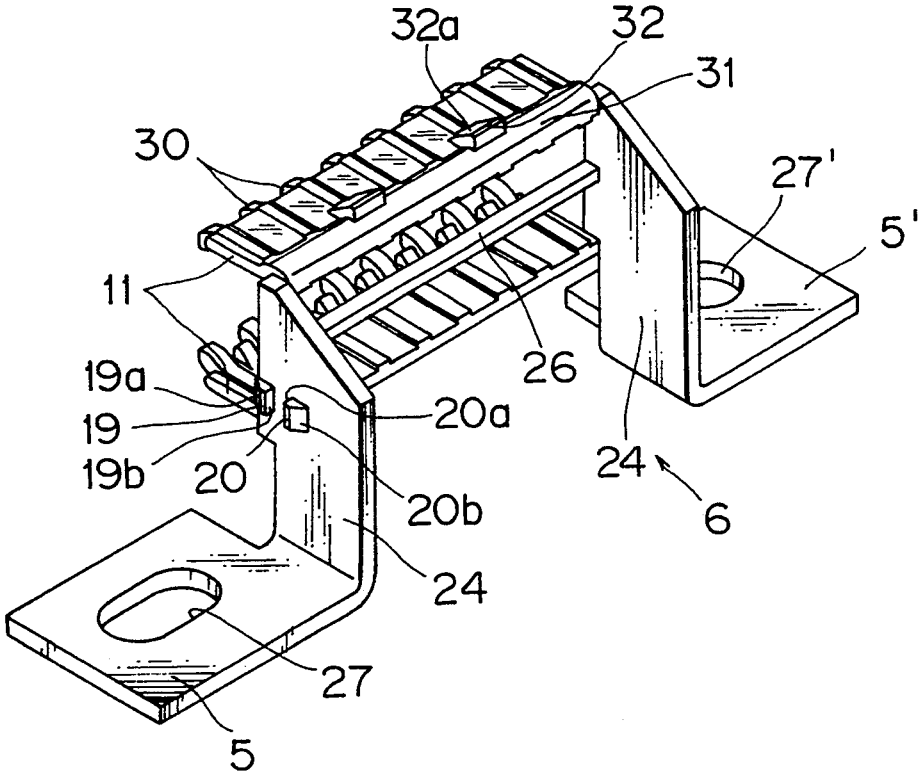
FIG. 6 is a perspective view of the rear holder.

Two-story connector accommodating cavities 7 are formed in the connector housing 3. A resilient lance 9 is formed on an intermediate wall 8 of the terminal accommodating cavities 7. Further, an insertion opening 12, through which an arm 11 for preventing the terminal from being slipped off is inserted, is formed on a rear portion of an outer wall 10 of the housing 3. The insertion opening 12 is in communication with the terminal accommodating cavities 7. Further, a locking projection 14 is formed on an inner wall 13 of the insertion opening 12, which is to be engaged with the arm 11. A frameshaped reap holder locking wall 15 is formed on an outer periphery of the insertion opening 12 and rectangular locking channels 17 for the arms 11 are formed on upper and lower walls of the rear holder locking wall 15 as illustrated in FIG. 4. An insertion channel 21 and a locking portion 6 which are engaged with a preliminary locking projection 19 and a preliminary locking maintaining projection 20 are formed on both side walls of the rear holder locking wall 15. The brackets 4 and 4' with panel mounting holes are integrally formed with the both side walls 18.

Figure 7:
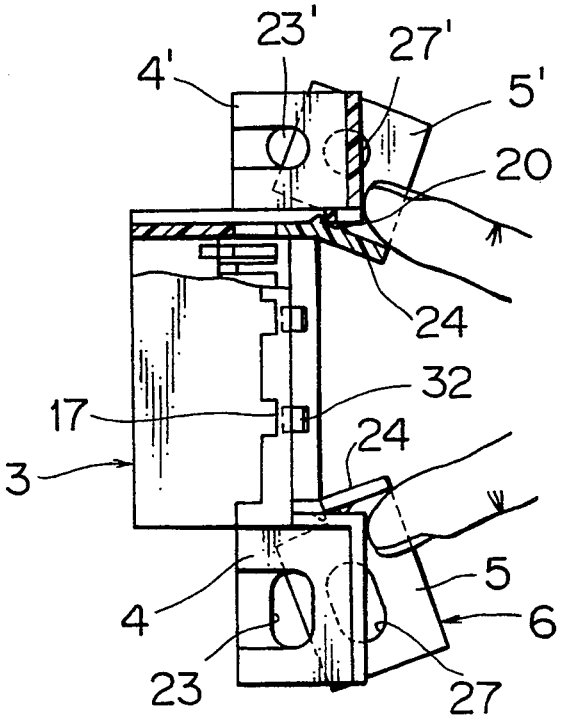
FIG. 7 is a plan view of the connector housing and rear holder in which side walls of the rear holder are bent to fully lock the rear holder to the connector housing.
Figure 8:
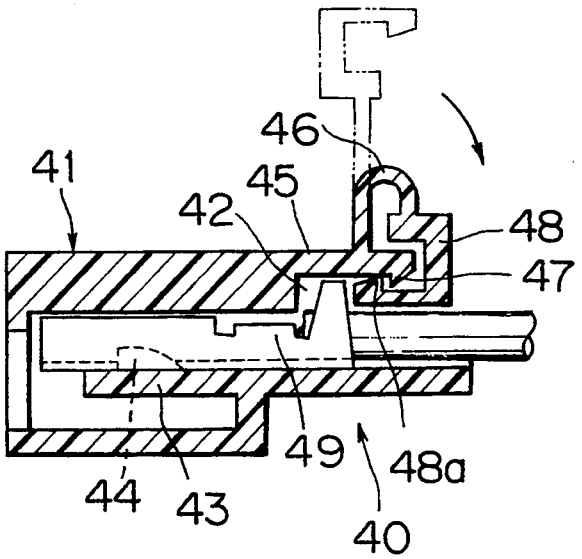
FIG. 8 PRIOR ART
FIG. 8 is a longitudinally cross-sectional view of the conventional connector.

A rear holder insertion space is formed inside the rear holder locking wall 15 and the side walls extend rearward. The insertion channel 21 of the side wall 18 is formed by cutting the side wall 18 from a rear end in the direction that the rear holder 6 is inserted so as to be in communication with the space. The locking portion 22 is positioned at a meddle of the channel 21. The brackets 4 and 4' are integrally formed with the side wall 18 at an lower end thereof and projects outward. The panel mounting hole 23 as a slotted hole is formed on the bracket 4 and another panel mounting hole as a drilled hole is formed on the other bracket 4' as illustrated in FIG. 7.

A pair of resilient tab-shaped arms 11 are attached to front portions of resilient side walls 24 of the rear holder 6, which are inserted into the two-story terminal accommodating cavities to prevent the terminals from being slipped off. Reinforcing bars 26 are positioned at the middle of the both arms. The pair of locking projections 19 and 20 are situated on outer walls of the resilient side walls 24. The preliminary locking projection 19 with a forwardly inclined face **19*a* and a rearwardly inclined face 19*b*, and the preliminary locking maintaining projection 20 with a forwardly abutting face 20*a* and a rearwardly inclined face 20*b* are positioned horizontally. The plate-shaped brackets 5 and 5' with bolt holes 27 and 27' are integrally formed with the side walls 24 at lower ends thereof. The bolt holes 27 and 27' correspond the mounting holes 23 and 23' of the brackets 4 and 4' of the housing 3**.

Figure 2:
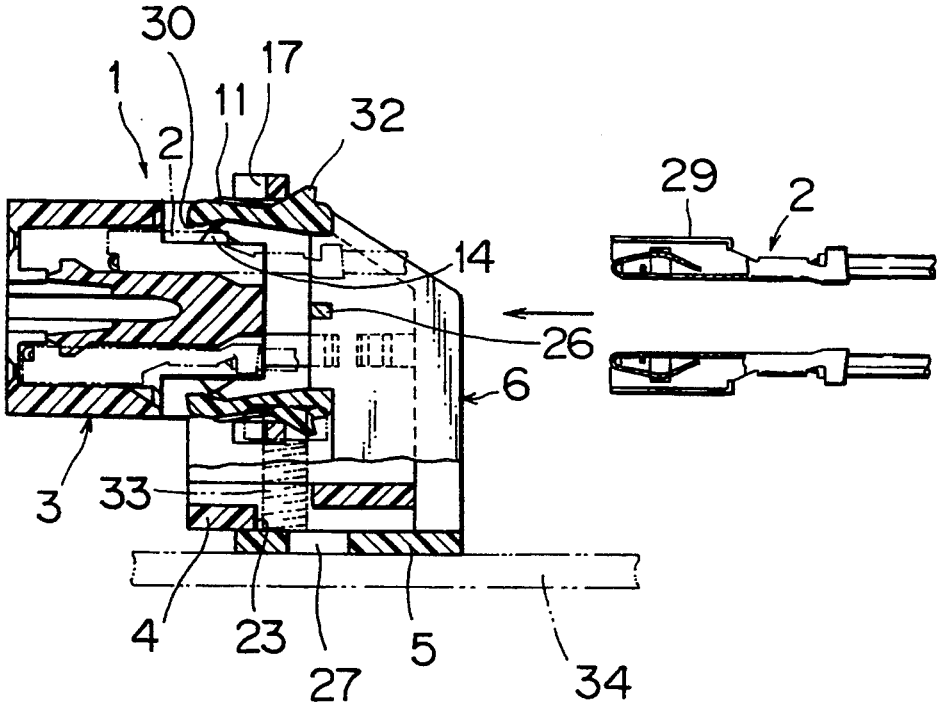
FIG. 2 is a longitudinally cross-sectional view of the connector shown in FIG. 1 under a preliminarily locked state of a rear holder to a housing or incomplete insertion of a terminal.

The arms 11 are provided with ends 30 which are bent like nails and abut rear ends of box-like contact portions of the terminals as illustrated in FIG. 2. A pair of main locking projections 32 with forwardly inclined faces **32*a* are attached to a base portion 31 of the arm 11. The resilient side walls 24 can be inwardly bent by fingers as illustrated in FIG. 7, which causes the main locking projections 32 to be locked to the locking channels 17 of the housing 3 while the preliminary locking maintaining projection 20 riding over the locking portion 22 so that the bolt holes 27 are apart from the mounting holes 23 of the bracket 4 of the housing 3**.

The locking projections 19 and 20 of the side walls 24 can be inserted into the insertion channel 21 of the housing 3. The distance L between the opposing faces **19*b* and 20*a* of the projections 19 and 20 is slightly larger than the locking portion 22. When the locking portion 22 is positioned between the faces 19*a* and 20*a*, the preliminarily locked state is obtained, and the faces 19*b* and 20*a* of the both projections 19 and 20 abut the locking portion 22 while the faces 19*b* and 20*a* opposing each other with the locking portion 22 in between, which prevents the rear holder 6 from being disconnected from the housing 3** during transportation.

One of the bolt hole 27 of the bracket 5 is formed as a slotted hole and the other as a drilled hole like the mounting holes of the brackets 4 and 4' of the housing 3. The resilient side walls 24 and the brackets 5 and 5' slidably contact with inner walls of the both side walls of the housing 3 and the bottom walls of the brackets 4 and 4' respectively as illustrated in FIG. 4.

When the terminal 2 is incompletely inserted into the terminal accommodating cavity 7, even though the rear holder 6 is caused to move from the preliminarily locked state to the fully locked state, the tip 30 of the arm 11 abuts the terminal 2, which prevents the terminal from being further inserted. As a result, the main locking projection 32 is not inserted into and engaged with the locking channels 17 and the rear holder 6 is not connected to the housing 3. Even though the bolt 33 is caused to be inserted into the mounting hole 23 of the housing 3 under the condition described above, the tip of the bolt 33 abuts a front face of the bracket 5 of the rear holder 6, preventing the bracket 5 from being fixed to a panel 34. Therefore, an incomplete insertion of the terminal 2 can be detected and the delivery of such defective is prevented.

Figure 3:
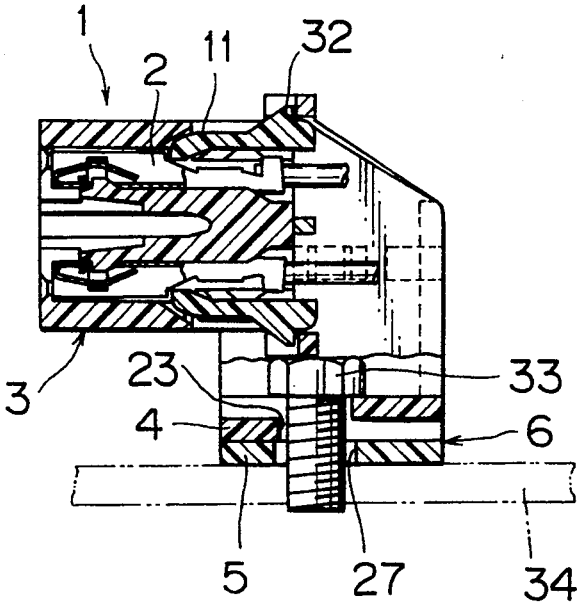
FIG. 3 is a longitudinally cross-sectional view of the connector shown in FIG. 1 under a fully locked state of the rear holder to the housing or complete insertion of the terminal.

When the terminal 2 is completely inserted into the terminal accommodating cavity 7 as illustrated in FIG. 3, the side walls 24 of the rear holder 6 are bent as illustrated in FIG. 7 to cause the preliminary locking maintaining projection 20 at the preliminarily locked state to engage the locking portion 22 of the housing 3 and to cause the main locking projections 32 to place the upper and lower walls 16 and engage the locking channels 17, which moves the housing 3 and the rear holder 6 to the fully locked state. Under this condition, the panel mounting hole 23 of the housing 3 and the bolt hole 27 of the rear holder 6 overlap each other to allow the bolt 33 to proceed into the both holes 23 and 27, which makes it possible to fix the connector 1 to the panel 34.

As described above, with the present invention, the mounting holes 23 and 23' of the brackets 5 and 5' of the housing 3 and the bolt holes 27 and 27' of the brackets 4 and 4' of the rear holder 6 do not coincide when the terminal 2 is incompletely inserted into the terminal accommodating cavity 7. As a result, the connector can not be fixed to the panel 34, which detects the abnormality in the connector and prevents it from being delivered.

What is claimed is:

1. An electrical connector comprising:

a connector housing having terminal accommodating cavities and brackets with mounting holes; and a rear holder inserted into said connector housing, said rear holder having arms for preventing terminals, which are accommodated in the terminal accommodating cavities, from being pulled out such that an end of each said arm abuts a rear portion of its respective terminal, said rear holder further having bolt holes which overlap said mounting holes of the brackets of the housing in a fully locked state of the rear holder to the connector housing.

2. An electrical connector as claimed in claim 1 further comprising:

a locking portion attached to the connector housing;

a pair of resilient vertical side walls attached to the rear holder;

a preliminary locking projection with a forwardly inclined face and a preliminary locking maintaining projection with forwardly abutting face attached to the side walls, wherein said locking portion of the connector housing is positioned between said preliminary locking projection and said preliminary locking maintaining projection in a preliminary locked state of the rear holder to the connector housing.

3. An electrical connector as claimed in claim 2, wherein said rear holder is further inserted into the connector housing while said pair of resilient side walls are bent inwardly to disconnect said preliminary locking maintaining projection from the locking portion of the connector housing and to move the rear holder and the connector housing to the fully locked state.

* * * * *